US005110133A

United States Patent [19]

Durso

[11] Patent Number: 5,110,133

[45] Date of Patent: May 5, 1992

[54] GOLF SWING TRAINING SYSTEM

[76] Inventor: Joseph M. Durso, 2224B Springwood Dr., Reston, Va. 22081

[21] Appl. No.: 726,162

[22] Filed: Jul. 2, 1991

Related U.S. Application Data

[63] Continuation-in-part of Ser. No. 642,160, Jan. 17, 1991, abandoned, which is a continuation-in-part of Ser. No. 542,774, Jun. 25, 1990, abandoned.

[51] Int. Cl.[5] ..... A63B 69/36

[52] U.S. Cl. ..... 273/187 R; 273/183 A; 273/DIG. 30; 273/195 A

[58] Field of Search ..... 273/195 A, 187 R, DIG. 30, 273/183 A, 195 R, 195 B, 176 J

[56] References Cited

U.S. PATENT DOCUMENTS

| | | | |
|---|---|---|---|
| 2,149,174 | 2/1939 | Johnson | 273/195 |
| 2,266,558 | 12/1941 | Lich | 273/195 |
| 2,786,683 | 3/1957 | Shapiro | 273/195 X |
| 2,790,640 | 4/1957 | Hoag | 273/195 |
| 2,941,808 | 6/1960 | Smith et al. | 273/187 |
| 3,129,944 | 4/1964 | Amos et al. | 273/195 |
| 3,348,847 | 10/1967 | Fischl | 273/195 |
| 3,414,266 | 12/1968 | Mitchell | 273/176 |
| 3,542,369 | 11/1970 | Anderson | 273/186 |
| 3,599,982 | 8/1971 | Elesh | 273/195 A |
| 3,627,328 | 12/1971 | Becker et al. | 273/187 R |
| 3,717,349 | 2/1973 | Bohnen | 273/186 R |
| 3,741,550 | 6/1973 | Landures | 273/186 R |
| 3,753,563 | 8/1973 | Previte, Jr. | 273/186 C |
| 3,815,923 | 6/1974 | Gaduto | 273/186 R |
| 3,880,432 | 4/1975 | Coffey et al. | 273/195 A |
| 3,992,011 | 11/1976 | Jessee | 273/183 A |
| 3,992,013 | 11/1976 | Golden | 273/186 D |
| 4,130,283 | 12/1978 | Lindquist | 273/195 A |
| 4,164,352 | 8/1979 | O'Brien | 273/187 A |
| 4,257,607 | 3/1981 | Nedwick | 273/DIG. 30 |
| 4,311,312 | 1/1982 | O'Brien | 273/195 A |
| 4,346,896 | 8/1982 | Russell et al. | 273/195 A |
| 4,355,810 | 10/1982 | Rydeck | 273/186 C |
| 4,387,896 | 6/1983 | O'Brien | 273/195 A |
| 4,844,470 | 7/1989 | Hammon et al. | 273/195 R |

FOREIGN PATENT DOCUMENTS

| | | | |
|---|---|---|---|
| 1494475 | 12/1977 | United Kingdom | 273/195 R |

OTHER PUBLICATIONS

O.G., May 22, 1990, p. 2699, abstracting, Buffey, Golf Practice Mat, Design Pat. 308,087, filing date May 18, 1987.

*Primary Examiner*—George J. Marlo
*Attorney, Agent, or Firm*—Christopher J. Rudy

[57] ABSTRACT

A golf swing training device includes a flat substantially rectangular base with two forwardly directable edges along which are located club head alignment aids, spikes for securing the base to a practice surface, a substantially rectangular hitting surface with two forwardly directable edges spaced apart a distance less than that between the two forwardly directable edges of the base, hook and loop fabric material for adjustably attaching the hitting surface to the base, and optionally, either a ball position pointer pivotably associatable with the base, which includes an elongate substantially parallel-sided pivotable rule with a pivot end and a pointer distal to the pivot end, or a golfer's square, which includes the ball position pointer or the like, an elongate substantially parallel-sided right rule rightly attachable to the pivotable rule, and hook and loop fabric material for attaching the rules. The device, or a suitable portion thereof, can be used to provide golf swing instruction.

21 Claims, 7 Drawing Sheets

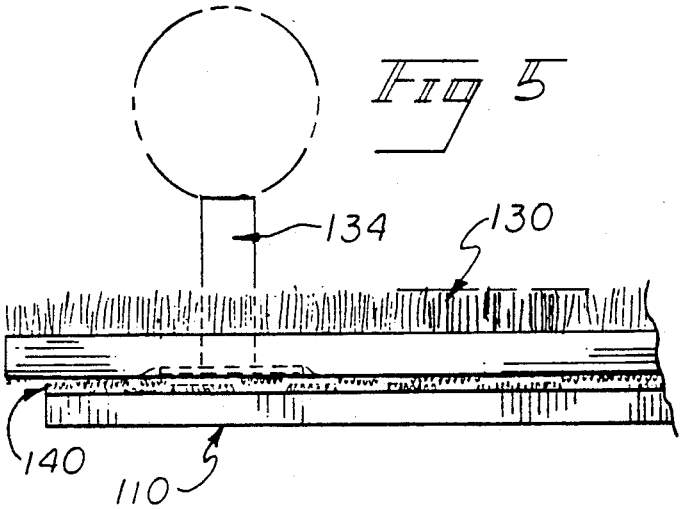
Fig 5
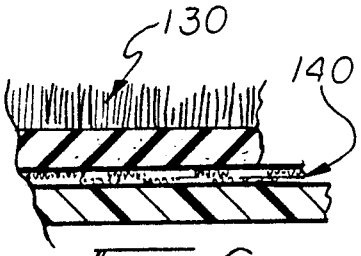
Fig 6
Fig 7
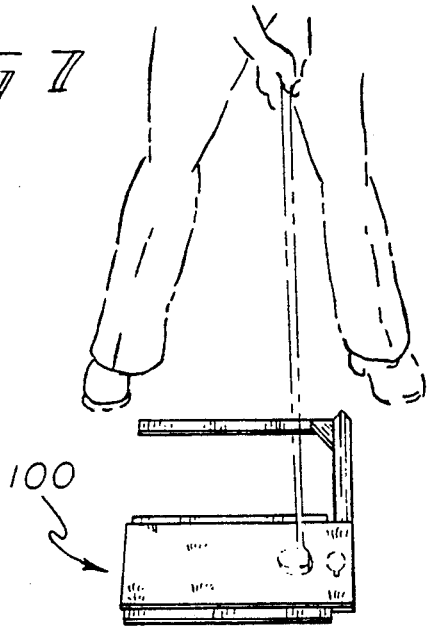
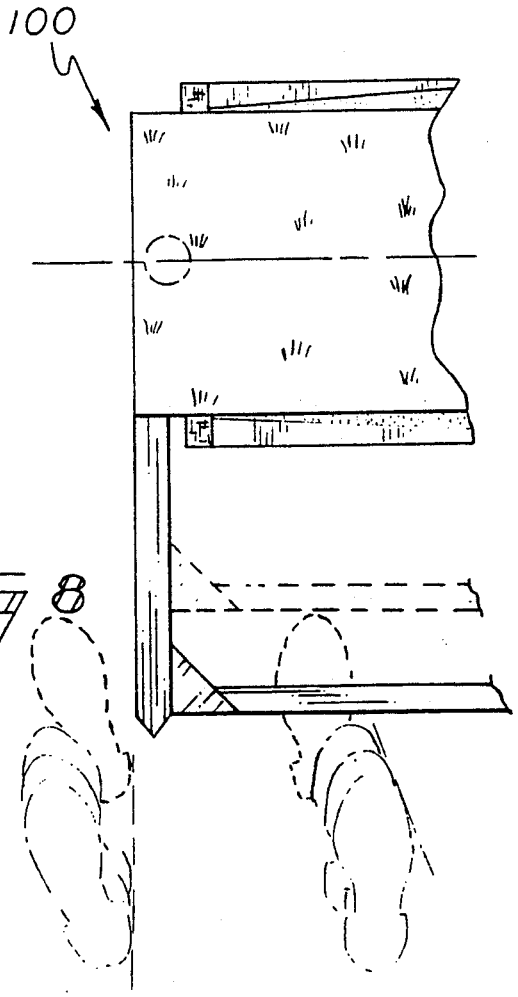
Fig 8

GOLF SWING TRAINING SYSTEM

CROSS-REFERENCE

This is a Rule 62 continuation-in-part of now abandoned application Ser. No. 07/542,774 filed on June 25, 1990.

FIELD

This invention concerns a golf practice article, its preparation and use. The invention is a useful amusement.

BACKGROUND

Golf is one of the most difficult to play of popular games in the world. It generally requires specific instruction, repeated application, i.e., perfect practice, concentration, and success under the pressure of competition in order to feel confidently skilled at every aspect of the game. For golfers this can be, and in many cases is, a lifelong endeavor. Lack of time, patience and discipline, compounded by the lack of a convenient place to practice, make it difficult for most golfers to practice effectively, as they must, to improve the score of their game. Unfortunately, often when most golfers do practice, imperfect practice renders much of the time and effort spent of little if any value because such imperfect efforts cannot be repeated with success on the golf course under the pressure of playing conditions. Like a person aspiring to learn to play the piano well, golfers must get specific instruction and then follow a rigorous practice schedule to gain repeatable proficiency. However, while the piano student knows that the keyboard will be the same in both practice and in concert, golfers contend with variables in play that can nullify the hardest practice efforts or that can even start bad habits that must be overcome to be successful. The basic result is that average scores seldom vary more than three or four strokes over a typical golfer's lifetime.

FURTHER INFORMATION

Johnson, U.S. Pat. No. 2,149,174 (Feb. 28, 1939), discloses a golf practice device. That invention relates to indoor golf tees.

Lich, U.S. Pat. No. 2,266,558 (Dec. 16, 1941), discloses an artificial golf tee. That invention relates to artificial golf tees for golf clubs and practice tee establishments.

Shapiro, U.S. Pat. No. 2,786,683 (Mar. 26, 1957), discloses a golf practice device. That invention pertains to golf practice devices or accessories, and more particularly to a form of a golf practice mat in combination with a tee or ball support, to enable practice shots to be made without damaging rugs or floors indoors, or the sod or club when used out of doors.

Hoag, U.S. Pat. No. 2,790,640 (Apr. 30, 1957), discloses a golf practice mat. The main objects of that invention are to provide: a brush construction, a brush construction which simulates turf and therefore is usable especially for practicing golf iron shots, means for securing the bristles in place on a mounting base which permits facile assembly of the brush and replacement sections of bristles that become damaged or excessively worn, a form of bristle-mounting base especially adapted for use in conjunction with a standard mat commonly used for teeing up golf balls for practice wood shots, and a brush construction of this kind which, by reason of its simple and practical structure, is extremely inexpensive to manufacture.

Smith et al., U.S. Pat. No. 2,941,808 (June 21, 1960), discloses a golf practice mat. That invention relates to a golf practice mat and more particularly to a device which may be used by a golfer to determine proper stance with respect to the golf ball and the desired direction of travel of the golf ball.

Amos et al., U.S. Pat. No. 3,129,944 (Apr. 21, 1964), discloses a golf mat composed of a plurality of parallel brush strips. That invention relates to a golf mat of the general type shown by McLaughlin, U.S. Pat. No. 2,668,711 (Feb. 9, 1954), reported to have several important advantages and to have been found generally satisfactory. Brush fibers forming the mats are resilient in character and resemble natural turf to some extent. Moreover, the mats find particularly advantageous use in the practice of fairway wood and iron shots as they eliminate the task of divot replacement and the need for relocation of practice tees due to excessive turf removal.

Fischl, U.S. Pat. No. 3,348,847 (Oct. 24, 1967), discloses a golf practice device including simulated divot means. That invention relates to a game practice device for improving game skill by practicing fundamentals of the game under conditions simulating actual game conditions, and more particularly it relates to a golf practice device.

Mitchell, U.S. Pat. No. 3,414,266 (Dec. 3, 1968), discloses a golf practice putting rug. In nature and gist that invention is a golf rug having three longitudinal area strips, each having a different pile height and disposed in a graduated manner from least height to tallest height. These area strips are sewn together with the aid of narrow demarcation strips of contrasting color disposed therebetween.

Anderson, U.S. Pat. No. 3,542,369 (Nov. 24, 1970), discloses a golf practice mat. In nature and gist that invention is a portable practice mat made of felted sisal fibers having its ends faced by a plastic material. A tee with a wide base extends upward through a centrally located hole in the mat. Indicia on the plastic material shows the direction of the target and the path that the head of the club should follow to drive a ball from the tee to the target. Additional indicia shows the proper position of the golfer's feet.

Elesh, U.S. Pat. No. 3,599,982 (Aug. 17, 1971), discloses a golf-practice mat. In nature and gist that invention is a practice mat for golfers, the mat of rubber of substantial length and width, containing no metal parts and having a cavity in one end of the face of the mat containing a brush removably secured in the cavity and to the mat, and the brush having an upstanding rubber tube extending from the lower portion of the rubber mat upwardly through the brush and extending upwardly above the brush surface, whereby golf iron shots may be practiced from the brush surface and golf wood shots may be practiced using the rubber tube.

Bohnen, U.S. Pat. No. 3,717,349 (Feb. 20, 1973), discloses a divot indicating golf practice mat. In nature and gist that invention is a golf practice mat formed of many separate strands of bendable members each individually extending upwardly from a base in spaced relation to one another to simulate blades of grass and a turfy surface of imitation grass, the individual strands being adapted to assume and stay in a bent condition impressed therethrough by the movement of a golf club head for collectively indicating the direction of such movement relative to a centerline aimed toward target until reset into upright condition preparatory to the next practice stroke of movement of a golf club head therethrough.

Landures, U.S. Pat. No. 3,741,550 (June 26, 1973), discloses a device for monitoring golf practice swings In nature and gist that invention is a device for monitoring golf swings during practice with a golf club, which utilizes knock-down pegs pivotally mounted in a practice pad in mutually spaced relationship along a strip of artificial turf. Each peg has a preferably integral foot formed as a transverse pivot pin and rotatably received by a journal recess formed in the underside of the practice pad, the normally upright portion of the peg extending upwardly through the practice pad to be knocked down if and when hit during a practice swing. The practice pad is molded from a flexible resilient material to provide integral detents bordering the recesses. These yield to permit insertion of the pegs from the underside of the pad and serve to retain the pegs in operative position once inserted.

Previte, Jr., U.S. Pat. No. 3,753,563 (Aug. 21, 1973), discloses a golf practice device. In nature and gist that invention is concerned with a device for practicing and improving a golf swing. It is most advantageously used when practicing with a wood or iron rather than with a putter. The device features two walls with an alley in between them, the alley having an artificial turf-like material thereon. The separation of the walls is adjustable so that the walls can be brought closer together as the golfer's swing improves. At least the wall closest to the golfer may be rotated to form different angles with the artificial turf. The angle can be adjusted to suit the size of the golfer and the particular golf club being used, and also to enable the golfer to establish a standard distance between himself and the ball. The bottom surface of the device includes two rotatably attached spikes for anchoring the device in the ground. The spikes may be rotated relative to the bottom surface and fitted into depressions which include constrictions for holding the spikes in storage positions.

Goduto, U.S. Pat. No. 3,815,923 (June 11, 1974), discloses a golf swing analysis mat In nature and gist that invention is a golf swing analysis mat having bicolored pliable fibers secured to a backing, wherein the fibers are combed to a uniform inclined position and upon being struck by the head of a golf club will be moved to a second position thus disclosing the direction of swing of the golf club. Each fiber comprises two sections secured together and to the backing by heat fusion thus providing an extremely durable and effective mat.

Coffey et al., U.S. Pat. No. 3,880,432 (Apr. 29, 1975), discloses a synthetic golf tee. In nature and gist that invention is a synthetic golf hitting area adaptable for receiving a golf tee upon which a golf ball is placed for striking, which includes a frame mounted on a subsurface and a synthetic grass like fabric which is mounted on and stretched across the frame. The grass like fabric is a pile carpet of knitted construction wherein the total yarn denier is from about 3,000 to about 10,000 and wherein the tuft density of the piles ranges from 24 to 64 per square inch with the pile height being from one-fourth inch to three-fourth inches.

Jessee, U.S. Pat. No. 3,992,011 (Nov. 16, 1976), discloses a heads down golf practice device. In nature and gist that invention is a heads down golf practice device having a resilient tubular golf tee member mounted in and protruding upwardly from a resilient, flat tee support structure base. The base includes a light emitting assembly having a light visible through the tee interior portion of the resilient tubular golf tee and mechanical indexing elements for randomly selecting a color of visible light. The support structure is placed in front of a golfer on a relatively flat surface in a desired location; a golf ball is placed on the tubular tee thereby covering the light which is otherwise visible through the tee interior at the tee top; a color is randomly selected by the golfer, and the golfer swings his golf club, striking the ball and setting it in flight, and observes the light color after the ball is struck and the club passes over the tee, if the golfer's shoulders, head and eyes are positioned correctly, the instant the golf club strikes the ball and passes over the tee.

Golden, U.S. Pat. No. 3,992,013 (Nov. 16, 1976), discloses a golf club swing training method. In nature and gist that invention provides a method and device for recording the swing of a golf club over a mat and permitting the analysis of the depth of the swing, the arc of the swing and the angle of the face of the golf club head when it contacts the mat. A resilient mat is covered with a thin film of chalk dust and a golf club head capable of dispersing the dust on the mat when it contacts the mat. The dust is dispersed in a pattern on the mat, which due to the attachment, permits analysis to determine the foregoing. The mat may also be provided with indicia related to a golf ball, and the equivalence of making a divot by the golfer may also be determined.

Lindquist, U.S. Pat. No. 4,130,283 (Dec. 19, 1978), discloses a simulated fairway subsurface for golf apparatus. In nature and gist that invention is a device for use in connection with a golf game or practice apparatus for simulating a fairway surface to enable a player to execute each shot as he would in actual play, especially enabling the player to "strike down" at the golf ball with the simulated feel of taking a chunk of turf but without damaging the simulated fairway surface. The device utilizes an artificial grass turf secured to a cushioned support that is movable in the direction of flight of the ball and compressible when the surface is struck during the golfer's swing. The movable and compressible portion of the artificial turf will return to its original position as soon as the club head is disengaged from the turf. The movable section of artificial turf together with the cushioned support thus provides the golfer with the same "feel" as if actual turf had been taken during the golf shot.

O'Brien, U.S. Pat. No. 4,164,352 (Aug. 14, 1979), discloses a golf swing practice mat. In nature and gist that invention is a training mat for golfers, which includes an area of artificial grass from which a teed golf ball may be driven, and a foot placement area on which the golfer stands. The mat contains diverse markings which enable a golfer to properly position his feet and the golf ball when using the different clubs of a set. A foot supporting wedge may be pivotally mounted on the foot placement area to support the golfer's rear foot.

O'Brien, U.S. Pat. No. 4,311,312 (Jan. 19, 1982), discloses an elastic cord suspended golf practice pad. In nature and gist that invention is a pad of synthetic grass slidably mounted within a rectangular frame by resilient members which connect the front and rear portions of the pad to the frame. The pad is adapted to slide on a horizontal surface, and return to its original position when a golf ball is struck therefrom. The resilient members may be cloth covered rubber cords which are attached to a center portion of the frame by a pivotedly mounted pulley.

Rydeck, U.S. Pat. No. 4,355,810 (Oct. 26, 1982), discloses a golf club swing training device. In nature and gist that invention has a plastic grass mat that shows the proper positions for the feet and hips in the modern one piece golf swing, in which the body and the golf club have to be coordinate. It gives the golfer the positions for putting, chipping, pitching, iron shots, and wood shots. A plastic or rubber guideway for the golf club is built into the mat, and it shows the golfer how to position and also how to rotate his shoulders properly. The guideway shows visually, manually, and physically how to swing the club through properly in the one piece modern golf swing. There is a tension spring in the guideway that squares the golf club face to the target and makes the ball go straight. The back end of the guideway is flared out so that incorrect swings are corrected while the golfer is learning. There is also a tension device that is used for pitch shots, iron shots, and wood shots that trains the golfer into the correct foot and leg action. It also shows him how to resist or hold back with his upper body while his lower body starts the downswing. Another feature of that apparatus is that the plastic grass mat rolls up into the guideway s the training apparatus can be used at home or easily taken to the office, school, or practice range. It can be used without balls, with plastic balls or with real golf balls.

Russell et al., U.S. Pat. No. 4,346,896 (Aug. 31, 1982), discloses a portable golf mat. In nature and gist that invention is a golf practice mat made up of two frames hinged together with one frame having an area where a golfer can stand to hold the mat to the ground, and the other frame has two playing surface regions on which balls to be struck can be played. One of the regions has a simulated grass-type surface, and the other region is formed of strips of rubber or rubber based material in an open weave pattern which can receive and support a tee without damaging the material. Bars or struts are located within the frames and provide support for the area where the golfer can stand and for the playing surface regions. The playing surface regions are movably supported in the other frame.

O'Brien, U.S. Pat. No. 4,387,896 (June 14, 1983), discloses a slidable golf practice device. In nature and gist that invention is a synthetic grass hitting surface slidably positioned within a rectangular frame and supported by a static surface. The sides of the frame and the static surface from slots. Sideward extensions of the base of the hitting surface are snugly fitted into the slots. The hitting surface is adapted to slide horizontally on the static surface when a golf ball is struck from the hitting surface, but the snug fit of the side extensions of the hitting surface in the slots and the drag of the hitting surface over the static surface causes resistance to displacement of the hitting surface.

Hammon et al., U.S. Pat. No. 4,844,470 (July 4, 1989), discloses a golf mat. In nature and gist that invention is a golf mat of a grass-like material, which includes top and bottom pads, each of which includes belting material which substantially strengthens them and protects the mat from damage from golf clubs striking it. The golf tee extend only through the top pad and not through the mat, and the belting material of the top pad prevents any enlargement of the hole through the top pad which includes felt carpet which also gives a grass-like appearance. The top pad is loosely secured to the mat and may be raised at its center for replacement of the tee, and the top pad absorbs energy from the golf club due to its ability to move relative to the mat when it is struck. The pad may be replaced through operation of the bolts at its opposite ends.

Buffey, U.S. Pat. No. Des. 308,087 (May 22, 1990) discloses a golf practice mat.

British Pat. Spec. No. 1,494,475 (Dec. 7, 1977), discloses improvements in or relating to games apparatus. According to that invention there is provided apparatus for practicing golf, comprising two members adapted to be placed on a flat surface with complementary edges in abutment, one member having means for receiving a device such as a tee for supporting a golf ball in a fixed position relative to the other member, the apparatus including markings on the two members enabling the members to be placed in particular positions relative to each other, the other member having marked locations for indication in use, the feet positions of a person using the apparatus.

Other Art

Becker et al., U.S. Pat. No. 3,627,328 (Dec. 14, 1971), discloses a golf practice device including stance coordinator. In nature and gist, that invention is a device to permit the practice of golf strokes both indoors and outdoors by striking a spring-loaded object representing the golf ball and including an adjustable arm including a footpad at its free end for controlling the stance of the golfer and holding the device in place on club impact. An indicia diagram is provided on the device to indicate to the golfer a yardage assimilation of his stroke.

Nedwick, U.S. Pat. No. 4,257,607 (Mar. 24, 1981), discloses golf swing guides. In nature and gist, that invention is a golf swing guide that serves as an aid for a correct golf playing stroke, the device including a base member adhered to a golf player's glove or midriff site, and an indicator member detachably attached by VELCRO fasteners to the base member, the indicator member including an upstanding, flat arrowhead including pointed side spurs of unequal lengths, a point and a plane of which are utilized directionally for accomplishing the correct stroke.

SUMMARY

The present invention, in one aspect, provides a golf swing training device comprising a flat substantially rectangular base having two forwardly directable edges a predetermined distance apart, means for securing the base to a practice surface, a substantially rectangular hitting surface having two forwardly directable edges spaced apart a predetermined distance more than the same as or less than the predetermined distance between the two forwardly directable edges of the base, means for adjustably attaching the hitting surface to the base, and optionally, either a ball position pointer pivotably associatable with the base, which comprises an elongate substantially parallel-sided pivotable rule having a pivot end and a pointer distal to the pivot end, or a golfer's square. Included are bases and hitting surfaces with a forwardly directed wedge-shaped portion and bases with sighting tabs. The golfer's square comprises the ball position pointer or the like, an elongate substantially parallel-sided right rule rightly attachable to the pivotable rule, and means for attaching the rules. In another aspect, provided is a method for providing golf swing instruction employing the golf swing training device and/or the ball position pointer or the golfer's square.

This invention is a useful amusement, for golf.

This invention overcomes many, many problems in the art. Numerous significant advantages attend it.

DRAWINGS

The drawings form part of the specification hereof.

In general in the drawings, like reference numerals refer to like features. In FIGS. 9 & 10, reference numerals that otherwise correspond with the reference numerals in FIGS. 1–8 have associated therewith the numeral "141" in parentheses.

FIG. 5 (FIG. 5) is a partial side sectional view of a golf swing training device of the present invention, attached, including a rubber tee for tee shot training.

FIG. 6 (FIG. 6) is a partial side view of a golf swing training device of the present invention, attached.

FIG. 7 (FIG. 7) is a perspective view of a golf swing training device of the present invention, as attached for straight tee shot training for the right-handed golfer, addressing the ball.

FIG. 8 (FIG. 8) is a top plan view of the device as generally depicted in FIG. 7, showing some of the positions that feet of the right-handed golfer may assume in golf swing training.

ILLUSTRATIVE DETAIL

Figure 1:
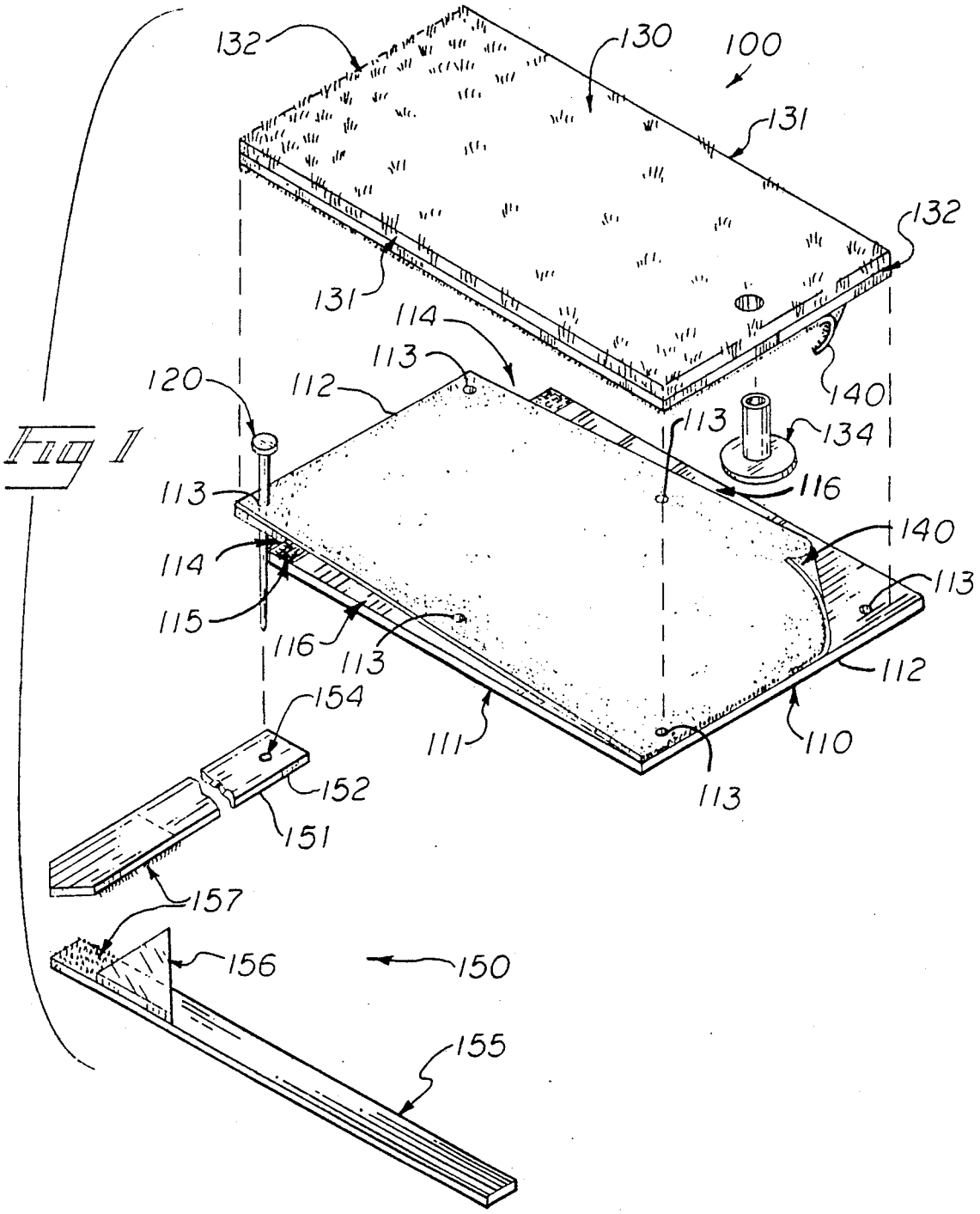
FIG. 1 (FIG. 1) is a perspective view of a golf swing training device of the present invention, separated.
Figure 2:
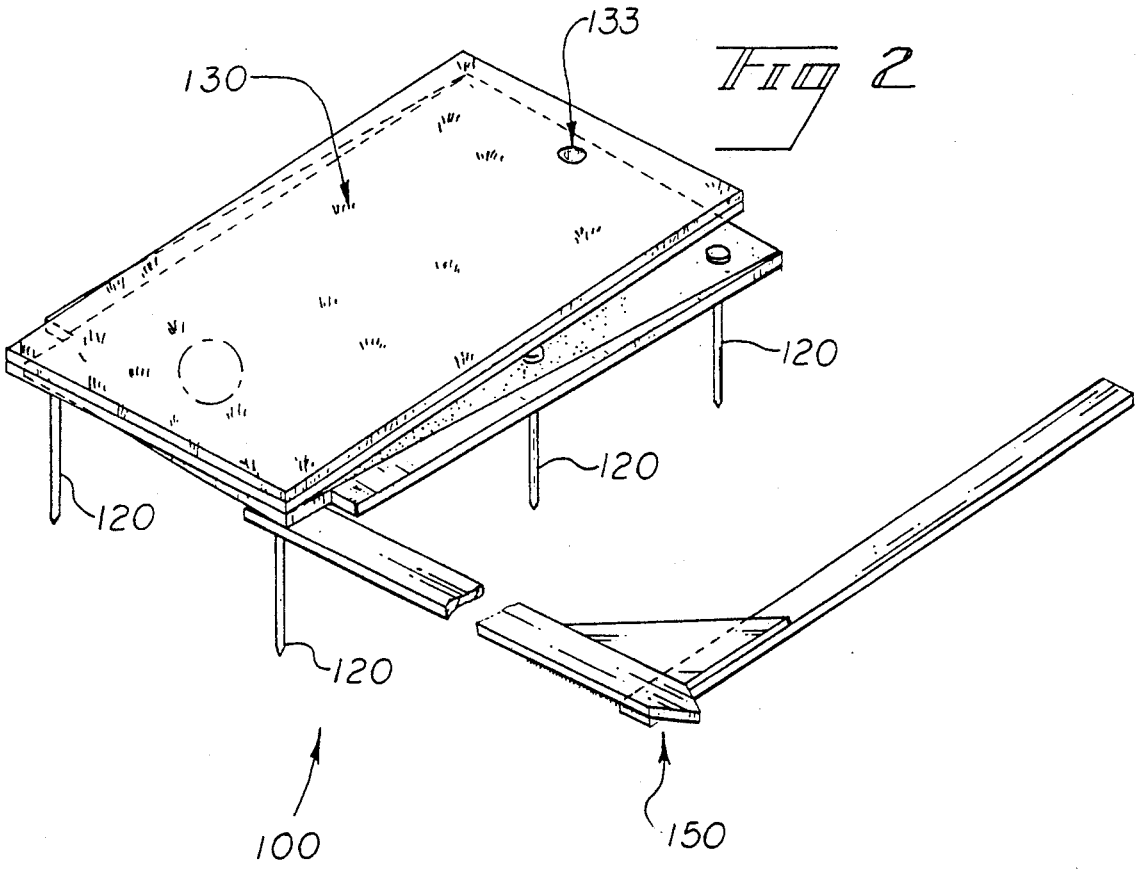
FIG. 2 (FIG. 2) is a perspective view of the golf swing training device generally of FIG. 1, as attached for fade shot training for a right-handed golfer.
Figure 3:
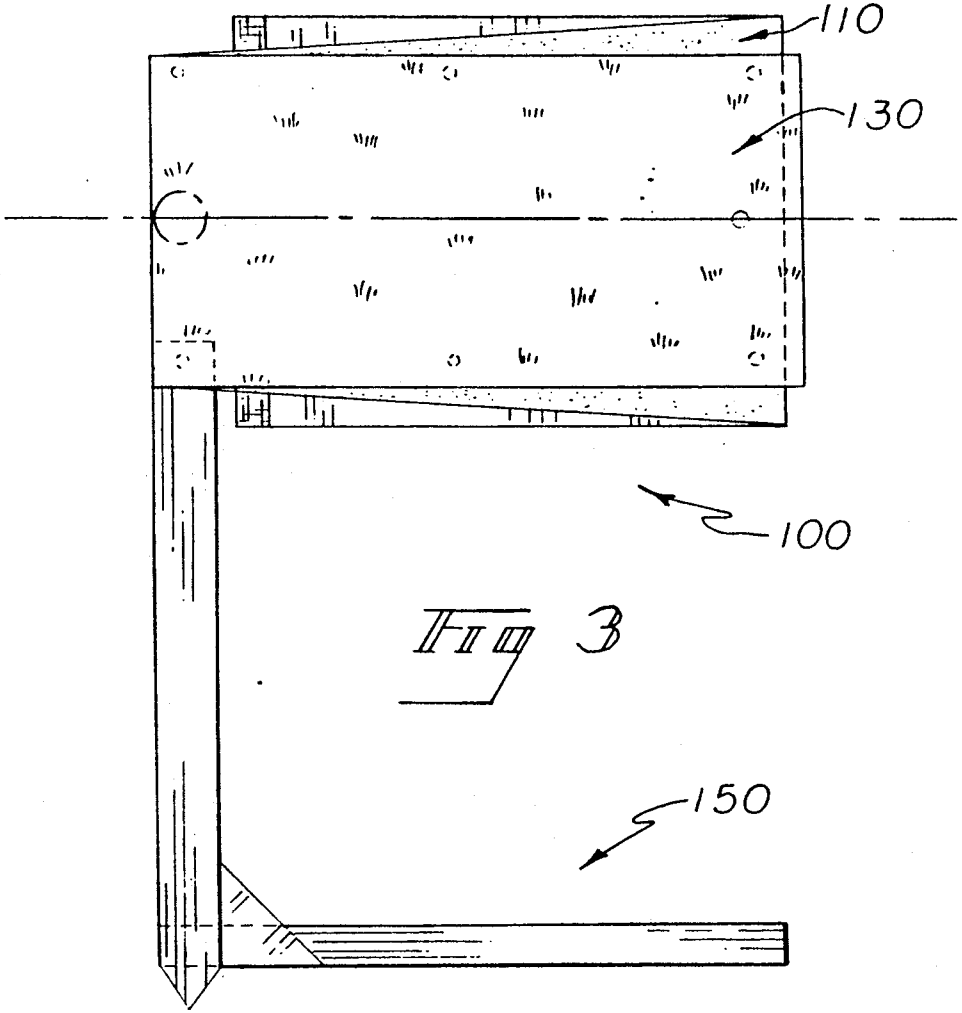
FIG. 3 (FIG. 3) is a top plan view of the golf swing training device of FIG. 2, as attached for straight shot training for the right handed golfer.
Figure 4:
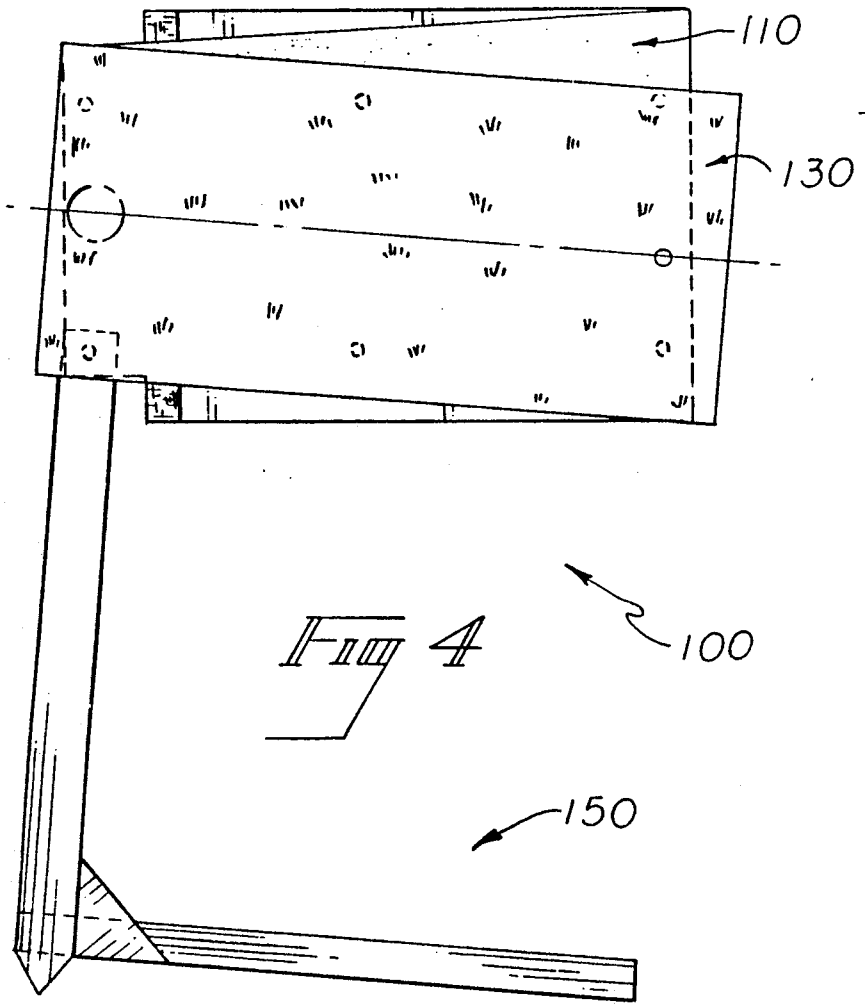
FIG. 4 (FIG. 4) is a top plan view of the golf swing training device of FIG. 2, as attached in position for draw shot training for the right-handed golfer.

In general, the golf swing training device of the present invention has:

1) A flat substantially rectangular base having two forwardly directable edges a predetermined distance apart.

2) Means for securing the base to a practice surface.

3) A substantially rectangular hitting surface having two forwardly directable edges spaced apart a predetermined distance less than the predetermined distance between the two forwardly directable edges of the base.

4) Means for adjustably attaching the hitting surface to the base, which means is one such that alignment and shiftability of the hitting surface in relation to the base is permitted readily and repeatedly by lifting the hitting surface from the base prior to executing a swing of a golf club in conjunction with the device yet such that anchoring of the hitting surface to the base is extant when the hitting surface is truck by the golf club in executing the golf swing. The present device can alternatively include:

5) A ball position pointer pivotably associatable with the base having an elongate substantially parallel-sided pivotable rule with a pivot end and a pointer distal to the pivot end.

6) A golfer's square. The golfer's square has:

A) The ball position pointer or the like.

B) An elongate substantially parallel-sided right rule rightly attachable to that pivotable rule.

C) Means for attaching the rules. Sundry embodiments are possible, and the golf swing training device of the present invention can be made by known methods or processes.

Generally, the device can be small. Preferably, it is at most about 2 feet (61 cm) along its forwardly directable edges by about 1 or so foot (30.5 cm) along its sidewardly directable edges, especially of its hitting surface, of course, with the distances along the sidewardly directable edges of the hitting surface generally being less than at least the rearward, e.g., non-notched, sidewardly directable edge of the base, by about 1½ inches (4 cm) in overall thickness, excluding any tee associatable therewith, and the ball position pointer is at most about 2 feet (61 cm) in length, and the said parallel-sided right rule of the golfer's square is at most about 2 feet (61 cm) in length.

In reference to the drawings, preferred golf swing training device 100 has flat rectangular base 110 of a suitably strong, supple substance, e.g., a solid plastic, preferably a solid polyvinyl chloride (PVC) such as rigid or rigid foam PVC, for example, commercially available CELTEC or CENTREX PVC, or the like, of a light coloration, or white, having two forwardly directable edges 111 a predetermined distance apart, e.g., 10 inches (25.4 cm), along two sidewardly directable edges 112. These two forwardly and two sidewardly directable edges are parallel to each other, respectively, and right angles are made at the intersections of the edges. The two forwardly directable edges, e.g., 13 inches (33 cm) not including additional length attributable to any notch which may be present, are longer than the two sidewardly directable edges, e.g., 10 inches (25.4 cm). Holes 113, e.g., ¼ inch (0.635 cm) in diameter, six each, are in the base. Notches 114, preferably symmetrical, e.g., each cut or molded to be 1 inch (2.54 cm) along the sidewardly directable edges by 2 inches (5.08 cm) along the forwardly directable edges, define that end of the base which is to be forwardly directed, i.e., in the direction of the flight of the struck ball. The notches can be useful for accommodating the ball position pointer pivotably associatable with the base and/or for presentation of a golf ball for ready alignment of a golf club used for striking the ball. Golf club alignment indicia 115, e.g., bright yellow lines ½ inch (1.27 cm) wide, are present on the base directly behind these notches to help remind a golfer to align the golf club face square to the target before starting a backswing.

Forwardly directed border 116 is present. Means 120 for securing the base to a practice surface is provided, e.g., by six flat headed 8-inch (20.32-cm) by ¼-inch (0.635-cm) aluminum spikes, which are driven into the practice surface, e.g., natural sod or turf, through the holes in the base to hold the base firmly even when the golf swing training device is struck during a golf swing. Rectangular hitting surface 130 is artificial but in imitation of the color and rough feel of natural turf grass, e.g., of nylon ASTRO TURF, or the like, which may be backed by a resilient or rubbery substance, especially when employed by beginning golfers where the backing may generally increase in thickness the less experienced the golfer is, but which backing is preferably absent, and has two forwardly directable edges 131 spaced apart a predetermined distance, e.g., 8 inches (20.32 cm) along two sidewardly directable edges 132. The distance along edges 131, e.g., 15½ inches (39.37 cm), is typically slightly longer than the distances along edges 111, e.g., 15 inches (38.1 cm), and the distances of edges 132, e.g., 8 inches (20.32 cm) are less than distance of edges 112, e.g., 10 inches (25.4 cm), to leave the forwardly directed border on the base. Too, these forwardly and sidewardly directable edges of the hitting surface are parallel to each other, respectively; right angles are made at the intersections of the edges, and the two forwardly directable edges are longer than these two sidewardly directable edges. The hitting surface has tee hole 133, e.g., ½ inch (1.27 cm) in diameter, in it near, e.g., 1 inch (2.54 cm) from, a sidewardly directable edge and equidistant from its forwardly directable edges. The tee hole is for insertion of a rubber tee 134 therethrough. Means 140 for adjustably attaching the hitting surface to the base is provided, e.g., by VELCRO pieces or the like, which include separate hook and loop portions suitably attachable to the base and the hitting surface, to make up an area 8 inches (20.31 cm) by 15 inches (38.1 cm) as from the use of two commercially available 4-inch (10.16-cm) wide strips, side-by-side, glued to the upper side of the base, equidistant from the two forwardly directed edges to leave two parallel 1-inch (2.54-cm) lightly colored, or white, borders, and glued to the under side of the entire hitting surface, with the hooked piece of the VELCRO thus glued onto the base and the looped piece of the VELCRO thus glued onto the hitting surface. Golfer's square 150 has elongate parallel-sided pivotable rule 151, e.g., of the same ¼-inch (0.635-cm) plastic as the base but being about 15 inches (38.1 cm) by 1⅝ inches (4.1275 cm), having a pivot end 152 and a pointer 153 distal to the pivot end. This rule alone is an embodiment of the ball position pointer pivotably associatable with the base of the golf training device of this invention. This golfer's square can be pivotably connected to the base, e.g., by insertion of one of the spikes through pivot hole 154, e.g., ¼ inch (0.625 cm) in diameter, and the appropriate corner hole of the base. Elongate parallel-sided right rule 155, e.g., of the same ¼ inch plastic as the base but in general being about 15 inches (38.1 cm) by 1 inch (2.54 cm), is rightly attachable to the pivotable rule, i.e., attachment of the rules can form a right angle therewith, between its ends but nearer to the pointer distal to the pivot end, e.g., as readily obtainable through right angle guide 156. Means 157 for attaching the rules is provided, e.g., by VELCRO pieces or the like glued to the lower side of the pointer-containing rule and the upper side of the right angle guide-containing rule. In general the device, e.g., with the dimensions exemplified for FIGS. 1-8, can weigh about 1 pound (454 g) or so and may be less than that.

Figure 9:
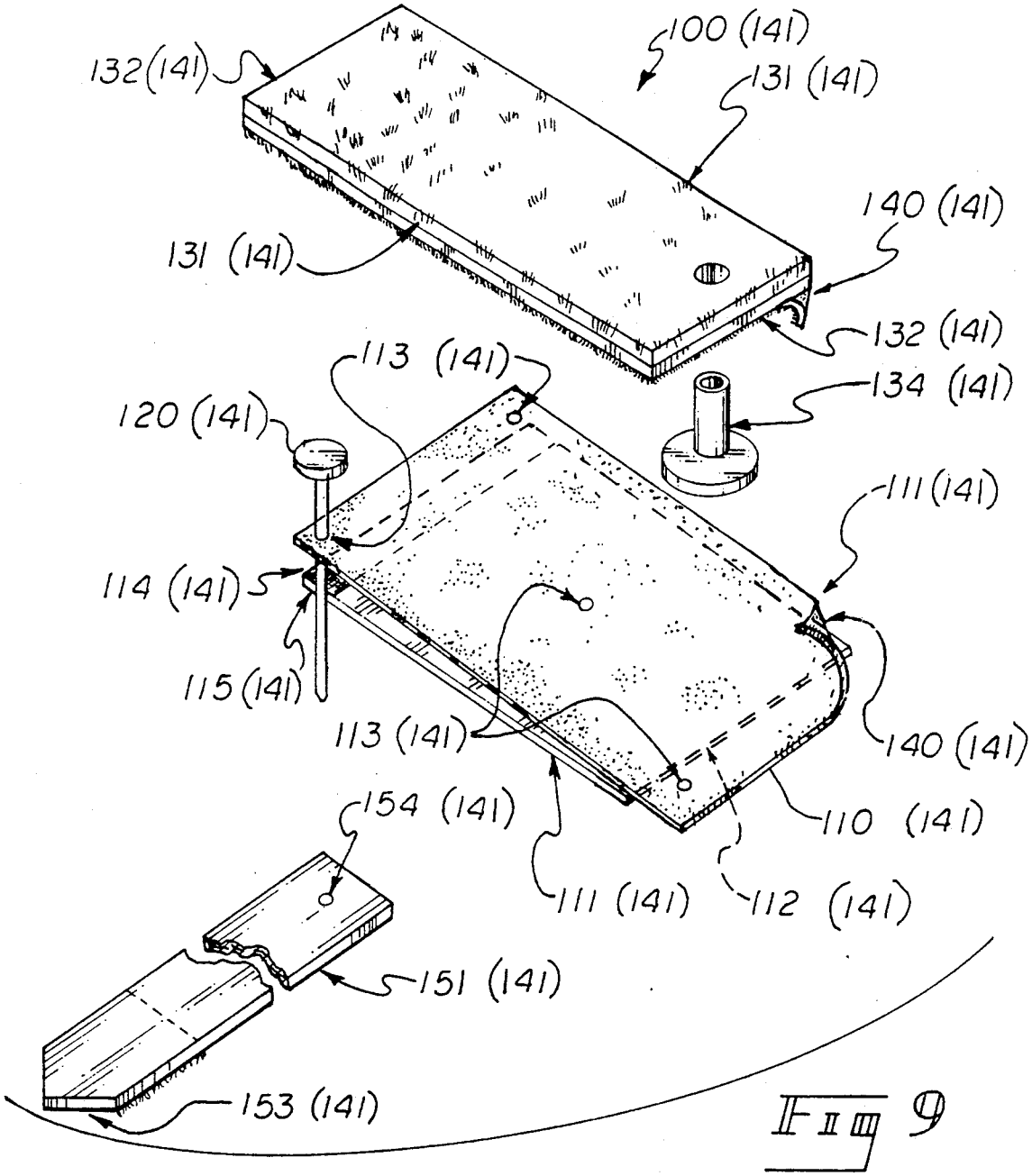
FIG. 9 (FIG. 9) is a perspective view of a golf swing training device of the present invention, separated.
Figure 10:
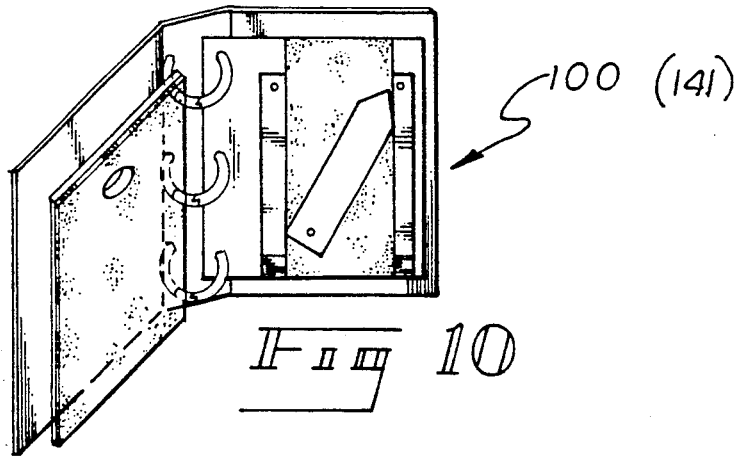
FIG. 10 (FIG. 10) is a perspective view of the golf swing training device generally of FIG. 9, as partially assembled and packaged as an insert in a binder with instruction pages.

In further reference to the drawings, especially in reference to FIGS. 9 & 10, salient dimensions of device embodiments of the present invention, e.g., made to include a ¼-inch (6 mm) thick rigid or rigid foam PVC base, etc., can include general feature dimensions such as those that follow:

| | |
|---|---|
| 110(141) | overall 6 × 11 inches (15 × 28 cm) and ¼ inch (6 mm) in thickness. |
| 111(141) | 9 inches (23 cm) excluding notch. |
| 112(141) | 6 inches (15 cm). |
| 131(141) | 11 inches (28 cm). |
| 132(141) | 4 inches (10 cm). |
| 151(141) | 11 inches (28 cm) in length ⅛ inch (3 mm) in thickness. |
| 114(141) | 1 × 2 inches (2.5 × 5 cm). |

The rigid or rigid foam PVC, for example in comparison with other suitable plastics, is generally less dense, can more readily accommodate gluing of such a material as, for example, VELCRO, thereto, and is nearly just as durable and weatherable if not more so. Furthermore, the device, e.g., especially with the smaller dimensions as exemplified for FIGS. 9 & 10, can be partially assembled and packaged as an insert in a binder, e.g., a 3-ring binder for accommodating letter- or A4-sized paper, in conjunction with pages of golf instruction. The device, e.g., with the rigid or rigid foam PVC base, etc., and especially with the smaller dimensions as exemplified for FIGS. 9 & 10, can be one that weights less than a pound (454 g) and thus be highly portable and adaptable as well.

Figure 11:
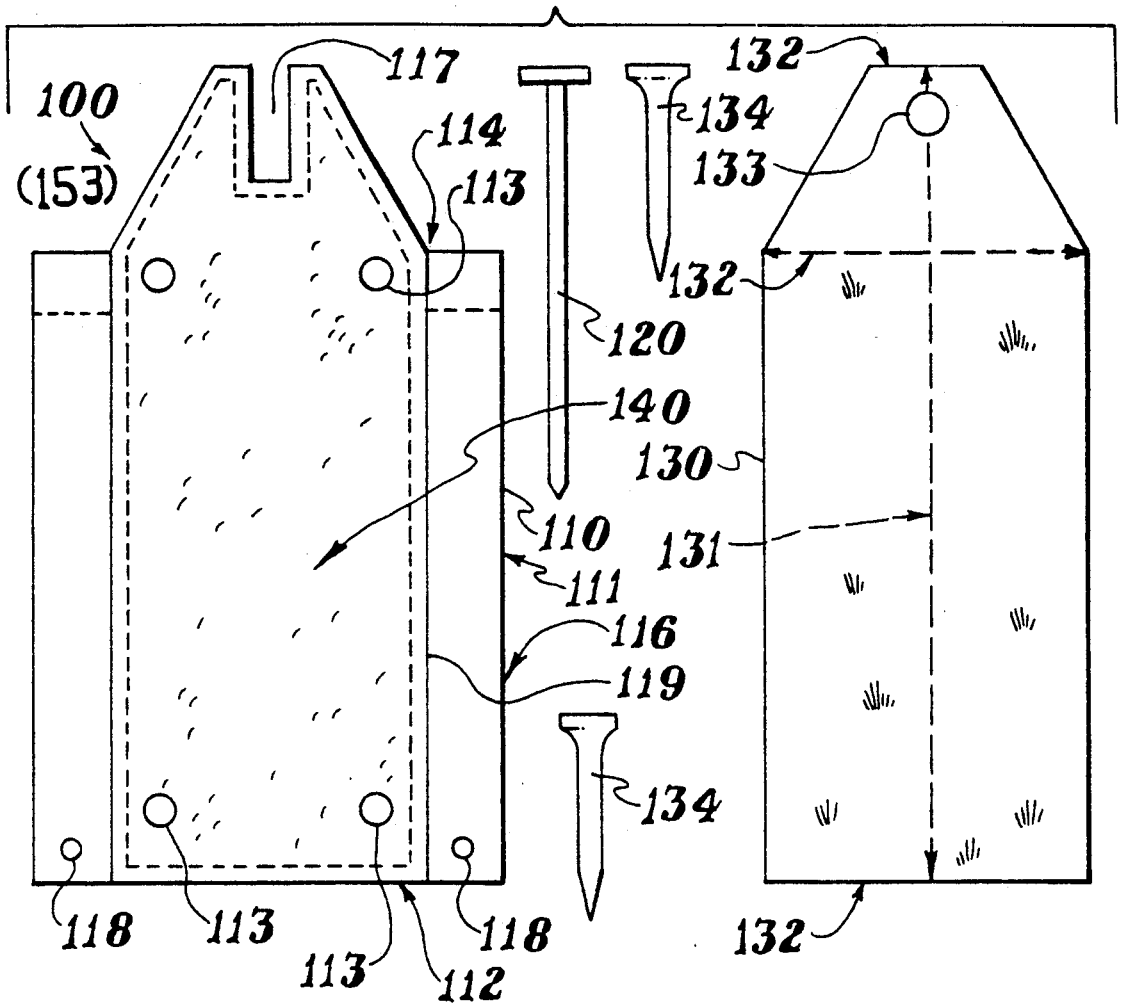
FIG. 11 (FIG. 11) is a top view of a golf swing training device of the present invention, having a forwardly directed directed wedge-shaped base and hitting surface portion, and an open-ended tee slot in its base, separated.
Figure 12:
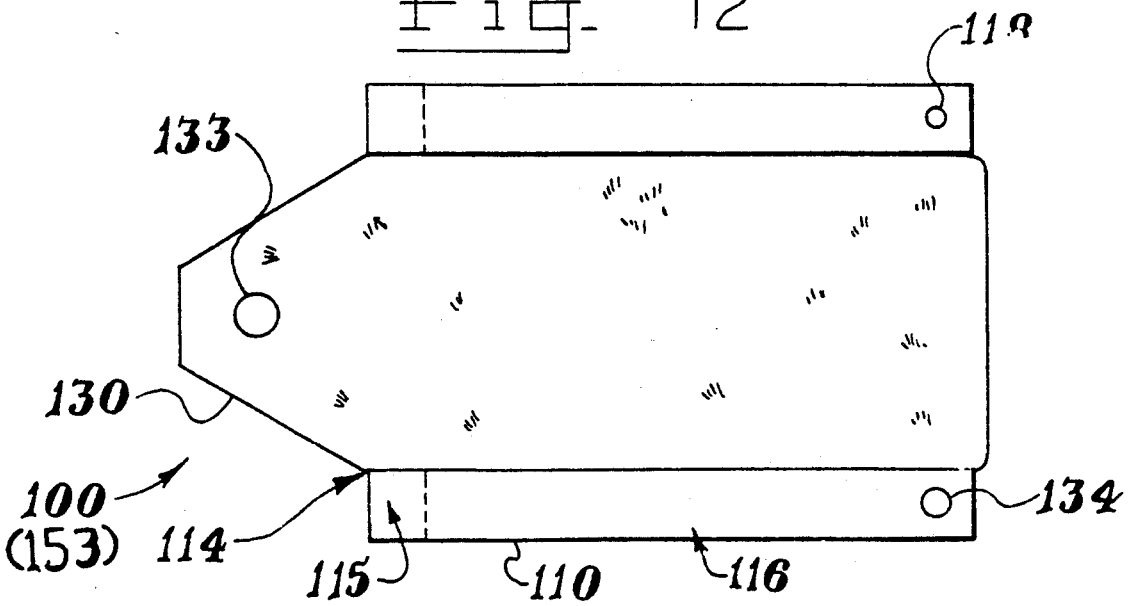
FIG. 12 (FIG. 12) is a top view of the golf swing training device generally of FIG. 11, assembled.
Figure 13:
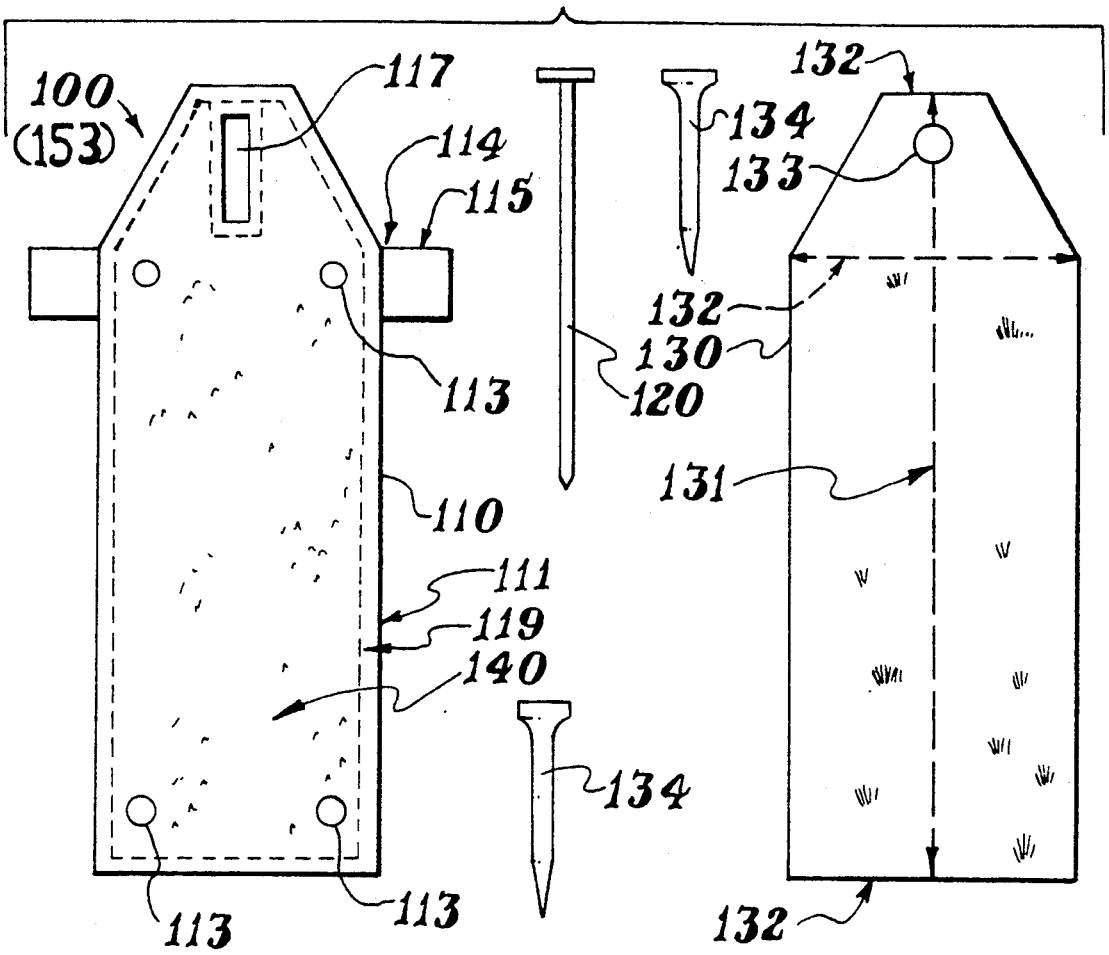
FIG. 13 (FIG. 13) is a top view of a golf swing training device of the present invention, with sighting tabs, a forwardly directed wedge-shaped base and hitting surface portion, and a closed-ended tee slot in its base, separated.
Figure 14:
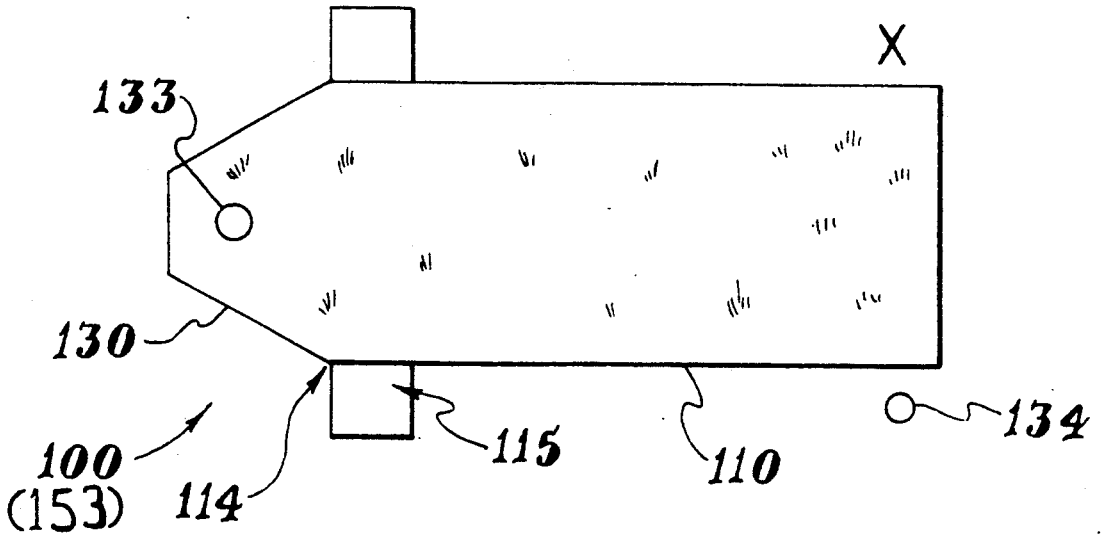
FIG. 14 (FIG. 14) is a top view of the golf swing training device generally of FIG. 13, assembled.

In yet further reference to the drawings, especially in reference to A) FIGS. 11 & 12 and to B) FIGS. 13 & 14, salient dimensions of device embodiments of the present invention, e.g., made to include a HYTREL 6356 (DuPont) plastic base, etc., can include general feature dimensions such as those that follow:

100(153)

A&B) Overall about ⅞ inch (2.2 cm) in thickness.

110(153)

A) Overall 6×10½ inches (15×26 cm); 3/16 inch (6 mm) thick base.

B) Overall 4×10½ inches (10×26 cm) excluding sighting tabs, and 3/16 inch (6 mm) in thickness.

111(153)

A) 8 inches (20 cm) excluding obtusely-angled notch.

B) 8 inches (20 cm) to notch but "cut-away" for about 7¼ inches (19 cm) or so along the side and up to the predetermined distance of the forwardly directed edges of the hitting surface to provide for sighting tabs 115(153), which protrude out sidewardly about an inch and are bout ¾ inch (0.8 cm) wide and which may be bright red.

112(153)

A) Back: 6 inches (15 cm).

B) Back: 4 inches (10 cm).

A&B) Forward: 4 inches (10 cm) across at notch, tapering to 2 inches (5 cm) at its forwardmost part.

131(153)

A&B) On center: 10½ inches (26 cm). 132(153)

A&B) Back: 4 inches (10 cm). Forward: 4 inches (10 cm) across at notch, tapering to 2 inches (5 cm) at its forwardmost part.

114(153)

A&B) 1 & 2¼ inch edges (2.5 & 5.5 cm) @115 degrees.

HYTREL (Reg. U.S. Pat. & Tm Off.), e.g., the HYTREL 6356, is a well-known engineering thermoplastic elastomer, a block copolymer of a hard (crystalline) segment of polybutylene terephthalate and a soft (amorphous) segment based on long-chain polyether glycols, the properties of which are determined by its ratio of hard to soft segments and make-up of the segments, and, in comparison with many other plastics, is very flexible, and extremely tough and strong, has a leather-like flex to it and can readily accommodate stitches 119(153) as in shoe working of such a material as, for example, 4-inch wide VELCRO 140(153), thereto, and is most durable and weatherable. Furthermore, this device, e.g., especially with the smaller dimensions as exemplified for FIGS. 11 & 12 and 13 & 14, can be partially assembled and packaged as an insert in a binder, e.g., a 3-ring binder for accommodating letter-sized or A4-sized paper, too, in conjunction with pages of golf instruction. This device, e.g., with the HYTREL 6356 base, etc., and especially with the smaller dimensions as exemplified for FIGS. 11 & 12 and 13 & 14, without a doubt, can be one that weights less than a pound (454 g) and thus be most highly portable and adaptable. The notches of this device can be cut to have an obtuse angle, e.g., bout from 110 to 120 degrees, rather than being only square, and the hitting surface and/or underlying base can be formed to accommodate this shape, which provides the forwardly directed wedge-shaped part, which most eloquently directs the golfer's activities in the proper direction during practice. The sighting tabs 115 (153) greatly assist in club face alignment, so essential for good practice and play, and absence of rear wide base portion 116(153) does not necessarily hurt practice but can actually engender better practice and play. In conjunction with the tabs 115(153) can be employed rear sighting aids, for example, a rear side hole 118(153) in through which a golf tee 134(153) or the like, e.g., of a color to match the tabs 115(153), can be inserted to assist in teaching stroke direction for the shot. See, FIGS. 11 & 12. Should there be only sighting tabs 115(153) with no rear side portion of the base 116(153) extending substantially beyond the sides of the hitting surface 130(153), as in FIGS. 13 & 14, the tee 134(153) or the like may simply be inserted in most any ground alongside the device, for example, in a position analogous to the rear side holes 118(153) marked with an "X." FIGS. 12 and 14 are depicted for left hand play. Also, a tee slot 117(153), say, about ⅜ inch (1 cm) or so wide by about an inch (2.54 cm) or so long, which may be open at the forwardmost edge (see, FIG. 11.) or may be closed off (See, FIG. 13.) there, can be provided in the base, into which a standard wooden-type golf tee 134(153) may be inserted through ½-inch (1.2 cm) or so hole 133(153) in the hitting surface. The tee hole 133(153) may be white. When a thus-teed ball is struck, say, with a driver, this tee can react to the impact with less likelihood of its breaking, and the shot becomes even more authentic than that which would occur with a rubber tee 134. This device is secured with spikes 120(153) too but may often be used without a ball position pointer or the golfer's square.

As aforesaid, the golf swing training device of the present invention can be made by known methods or processes. Accordingly thus, plastics, treated leathers or plastic imitations thereof, and so forth can be employed. Suitable plastic materials can include nylon, plasticized acrylic polymers, polyolefin polymers such as HDPE or LDPE, rigid or foamed PVC, the HYTREL especially, e.g., HYTREL 6356. As is known in the art, such plastics may be extruded and so forth, and other components such as, for example, 4-inch wide VELCRO HOOK and loop material, may be attached such as by gluing, sewing, and/or hot pressing, etc., and final shapes can be obtained by cutting, drilling, etc. Desirably, the device is at most about 1½×⅝ feet (46×21 cm), and even more so, it is even more compact.

In practice, the ball is preferably placed forward on the hitting surface or tee, with the hitting surface being aligned straight for straight shots, aligned with its forward end toward the inside for a deliberate fade, or slice, and aligned with its forward end toward the outside for a deliberate draw, or hook, always with the base remaining aligned straight toward the desired target. Preferably, the pointer is positioned at a right angle to the forward direction of the hitting surface, say, somewhat toward the inside of the golfer's forward heel, and the golfer's square is positioned parallel to the forward direction of the hitting surface behind the pointer or the like. The golfer lines up his feet and shoulders parallel with the rightly attachable rule of the golfer's square and thus with the initial line of flight, as defined by the forwardly directed sides of the base, of any good shot, whether it be straight, to include puts, or a fade or a draw. The golfer's feet are placed an appropriate distance apart and an appropriate distance from the ball such as in position to hit a wood shot, where the feet are generally positioned farthest apart and farthest from the ball, a short iron shot, where the feet are generally positioned closest together and closest to the ball, or a long or mid iron shot, where the feet are generally positioned somewhat between those two extremes. See e.g., FIGS. 7 & 8. The present invention is an excellent means of practicing the putting stroke. Another ball placed behind the ball to be struck may be pushed back beyond the length of the hitting surface in excellent practice of a good backswing for wood or iron shots or for putting.

The forward positioning of the ball on the hitting surface provides the most authentic practice benefit known from an artificial surface. This is of utmost importance because as is known in the game an iron shot properly struck actually makes contact with the ball before the club reaches the bottom of the swing. Since there are no obstructions front or back, the ball placement at the forward edge of the hitting surface allows the club to strike the ball, continue down and out past the leading edge of the hitting surface and then up in the course of the natural swing. In this way, the golfer can make a rapid spin on the ball, which is vital to the golfer's ability to control the flight and/or bounce of a ball. The most authentic and natural like feel from the forward positioning of the ball on the hitting surface is unlike that found, for example, when the ball is struck from a more centralized portion of the hitting surface (or in the ball placement of known mats) where an unnatural bump or bounce of the club occurs upon hitting the ball. With the present invention, a practice iron shot off artificial turf feels virtually the same as a shot off natural turf.

In addition, because the most important part of a good golf swing is the first 18 inches (45.72 cm) of the takeaway, i.e., start of the backswing, the present invention capitalizes most effectively on this through its preferred hitting surface. The placement of the ball on the forward edge of the hitting surface is an excellent if not essential guide to a good backswing as well as the downswing in that the full preferred forwardly directed surface is visible behind the ball position, encouraging the golfer to swing back and forward along the extended surface to the ball.

The golf swing practice device is portable. Yet, it can be firmly emplaced through its base for an extended period, say even, over a year.

When it is desired to practice hitting balls off real grass, the pointer and/or golfer's square can be employed without the base, hitting surface, and so forth. The trained golfer merely places the pointer and/or golfer's square on the ground appropriately as otherwise in use with the base, hitting surface, and so forth, and begins practice, e.g., before a match with practice golf balls. At this time, all of the things learned by practicing with the present invention with its base, hitting surface, and so forth is applied to real turf conditions, but with the pointer and/or golfer's square weaning the golfer ever closer to no training device assistance at all.

In general thus, the present invention can help correct errors golfers make in setup and direction sighting, before the swing even begins. Golf in many ways is a game of optical illusions, and until the eye becomes trained, practicing golfers often think that they are lined up square to the target when actually they are aiming their shot to the right or to the left. The present invention solves the problem of incorrect alignment by visually prompting a golfer to set up square to the desired line of flight of the ball so that all of the aspects of a golf swing can work properly toward the desired outcome. In addition, divot taking, which otherwise creates another variable for the next swing, can still be practiced yet the golfer need not move the mat to accomplish this as the ball is placed on the forward portion of the hitting surface so that a divot is properly taken, off the mat, whilst the mat, being nearly indestructible, remains to be used again and again. Moreover, the small size of the mat allows for positioning of the golfer's feet on natural turf, generally like that which would be encountered on a golf course. Furthermore, the present invention solves the problem of practice in adverse weather where it is almost impossible to practice hitting golf shots in the rain, for example, in that the ground gets wet so that dirt from the divots taken upon hitting the ball turns to mud on the club face necessitating constant cleaning, because it can be used regardless of the weather with clean hits time after time off a hitting surface not affected by water, which results in the serious golfer being able to practice in adverse weather and learning to overcome the physical and mental problems such weather engenders.

Some summarized advantages and features hereof follow:

1) Portable. Generally, it can be used anywhere there is enough room to hit the shot a golfer wishes to practice, and it may be transported in a golf bag.

2) Nearly indestructible. A suitable plastic, e.g., rigid or rigid foam PVC, base can be left out in nearly any weather. An ASTRO TURF or the like mat will absorb thousands of hits with no fraying and can be easily replaced if extended use makes it necessary.

3) Safe. A VELCRO or the like material to bond the hitting surface to the base and cover anchoring spikes eliminates possible damage to golf clubs. The tough, natural looking space-age materials used will absorb any swing attempt, good or bad, without marking or scratching most golf clubs.

4) Adjustable. The hitting surface can be moved on the base for straight, fade, and draw shots.

5) Convertible. The hitting surface converts to driver practice with the tee insert. Merely remove the hitting surface, turn it 180 degrees, and replace it on the base with the tee positioned.

6) Solid. The base will not move when it is staked down, and the hitting surface attached to it with VELCRO or the like holds firm regardless of the force of the hit.

7) Natural. The golfer stands on natural grass to swing; so practice lessons mimic golf course conditions. There are no functional distractions to be concerned with as the golfer practices.

8) All-weather. Practice can be carried out when the ground would otherwise be too saturated with water or when the ground is devoid of grass and even hard. Practice can be done while it is raining to help get used to such conditions.

9) Ball-position pointer. This indicates the position of the forward heel in relation to the ball. It easily adjusts to maintain a proper right angle as the hitting surface is adjusted 10) Golfer's square. This reminds the golfer of the proper lineup and stance.

11) Instructional back and downswing guide. The adjustable-to-the-target-line hitting surface with the ball placed at the front provides a powerful visual guide to the all-important inside out swing maneuver.

Symmetrical. The base, hitting surface, notches and markings can be symmetrical; so the device works as well for right and left handed golfers.

13) Indoor use. When the hook portion of VELCRO or the like is cemented to the bottom of the hitting surface, it will adhere to loop carpet or most indoor-/outdoor carpet. The training benefits still apply and practice swings can be made without a ball or even with a plastic ball. A real ball can be used if the inside space is large enough for a net.

14) Putting. The line-up feature of the device, with or without the pointer and/or golfer's square, make the present invention an excellent trainer for a smooth, accurate putting stroke.

Instructable. Although a self-training device, the devices of this invention can be employed with professional instruction, books and/or video taping.

16) Adaptable. The device of the present invention may be made of a size suitable for it being packaged, e.g., to include use of shrink-wrap plastic, and storage with an associated instruction binder, in addition to its being useful as an actual golf swing training device. Numerous further advantages inherently attend this invention as well.

CONCLUSION

The present invention is thus provided. Numerous adaptations and modifications can be effected by those of skill in the art within the spirit hereof, the scope of which is particularly pointed out by the following distinctly claimed subject matter.

What is claimed is:

1. A golf swing training device comprising a flat elongated, at least generally rectangular base having two forwardly directable edges spaced a predetermined distance apart, means for securing the base to a practice surface, an elongated, at least generally rectangular, flexible, turf-like hitting surface having two forwardly directable edges spaced apart a predetermined distance more than, the same as, or less than the predetermined distance between the two forwardly directable edges of the base, means for aligning the face of a club head relative a target located along the forwardly directable edges of the base and extending beyond the forwardly directable edges of the hitting surface when positioned thereon, means for adjustably attaching the hitting surface to the base and lowering same thereto such that alignment and shiftability of the hitting surface in relation to the base is permitted readily and repeatedly by lifting the hitting surface from the base prior to executing a swing of the golf club in conjunction with the device yet such that said hitting surface and base remain attached when the hitting surface is struck by the golf club in executing the golf swing.

2. The device of claim 1, wherein the base and the hitting surface are substantially rectangular, said hitting surface having two forwardly directable edges spaced apart a predetermined distance substantially the same as or less than the predetermined distance between the two forwardly directable edges of the base, and notches are present in the forward portion of the base, the notches useful for accommodation of a ball position pointer pivotably associatable with the base and useful for presentation of a golf ball for ready alignment of a golf club used for striking the ball, and which device is at most overall about 2 feet in length along the forwardly directable edges and at most about 1 foot in length along sidewardly directable edges of its hitting surface.

3. The device of claim 2, wherein the means for adjustably attaching said hitting surface to the base includes separate hook and loop portions suitably attached to the base and said hitting surface.

4. The device of claim 3, wherein the base has a plurality of holes suitable for insertion of a spike through each and the means for securing the base to a practice surface includes spikes.

5. The device of claim 3, which is about 9 inches along forwardly directable edges of its base, excluding notches which are indented about 1 inch along sidewardly directable edges and about 2 inches along the direction of the forwardly directable edges and said hitting surface being about 11 inches along its forwardly directable edges, and said base being about 6 inches wide along its sidewardly directable edges, and said hitting surface being about 4 inches wide along its sidewardly directable edges.

6. The device of claim 5, which further comprises a ball position pointer that is about 11 inches in overall length.

7. The device of claim 6 which is partially assembled and packaged for insertion in a suitable binder suitable for holding letter-or A4-sized paper.

8. The device of claim 7, further comprising said binder.

9. The device of claim 5, which is partially assembled and packaged for insertion in a suitable binder, and which further comprises said binder.

10. The device of claim 1, wherein said hitting surface has two forwardly directable edges spaced apart a predetermined distance substantially the same as or less than the predetermined distance between the two forwardly directable edges of the base, and notches are present in the forward portion of the base, the notches useful for presentation of a golf ball for ready alignment of a golf club used for striking the ball, and which device is at most overall about 1½ feet in length along the forwardly directable edges and at most about ⅔ foot in length along sidewardly directable edges of its hitting surface, wherein said notches have an obtuse angle such that a forwardly directed wedge-shaped part is provided in the base, with an outline of substantially the same wedge-shape occurring in said hitting surface as well.

11. The device of claim 10, wherein the means for adjustably attaching said hitting surface to the base includes separate hook and loop portions suitable attached to the base and said hitting surface.

12. The device of claim 11, wherein the base has a plurality of holes suitable for insertion of a spike through each and the means for securing the base to a practice surface includes spikes.

13. The device of claim 1, further comprising a ball position pointer pivotably associatable with the base, which comprises an elongate parallel-sided pivotable rule having a pivot end and a pointer distal to the pivot end.

14. The device of claim 13, further comprising a golfer's square, which in addition to the ball position pointer comprises an elongate parallel-sided right rule rightly attachable to the pivotable rule and means for attaching the rules.

15. The device of claim 14, wherein said means for attaching the rules includes separate hook and loop portions.

16. The device of claim 1, which has a base of a nylon or an engineering thermoplastic elastomer which is a block copolymer of a hard segment of polybutylene terephthalate and a soft segment based on long-chain polyether glycols.

17. A method for providing golf swing instruction comprising swinging or directing swinging of a golf club at a golf ball placed forwardly on a golf swing training device comprising a flat substantially rectangular base having two forwardly directable edges a predetermined distance apart, means for securing the base to a practice surface, a substantially rectangular hitting surface having two forwardly directable edges spaced apart a predetermined distance, means for aligning the face of a club head relative a target located along the forwardly directable edges of the base and extending beyond the forwardly directable edges of the hitting surface when positioned thereon, means for adjustably attaching the hitting surface to the base such that alignment and shiftability of the hitting surface in relation to the base is permitted readily and repeatedly by lifting the hitting surface from the base prior to executing a swing of a golf club in conjunction with the device yet such that said hitting surface and base remain attached when the hitting surface is struck by the golf club in executing the golf swing.

18. The method of claim 17, wherein the device further comprises a ball position pointer pivotably associatable with the base, which pointer comprises an elongate parallel-sided pivotable rule having a pivot end and a pointer distal to the pivot end.

19. The method of claim 18, wherein the device further comprises an elongate parallel-sided right rule rightly attachable to the pivotable rule, and means for attaching the rules to provide a golfer's square.

20. A golf swing training device comprising a flat at least generally rectangular base having two forwardly directable edge spaced a predetermined distance apart, means for securing the base to a practice surface, an at least generally rectangular, flexible, turf-like hitting surface having two forwardly directable edges spaced apart a predetermined distance substantially the same as or less than the predetermined distance between the two forwardly directable edges of the base, means for adjustably attaching the hitting surface to the base and lowering same thereto such that alignment and shiftability of the hitting surface in relation to the base is permitted readily and repeatedly by lifting the hitting surface from the base prior to executing a swing of a golf club in conjunction with the device yet such that said hitting surface and base remain attached when the hitting surface is struck by the golf club in executing the golf swing, wherein notches are present in the forward portion of the base, the notches useful for alignment of a golf club used for striking the ball, said notches having an obtuse angle such that a forwardly directed wedge-shaped central part is provided in the base, with an outline of substantially the same wedge-shape occurring in said hitting surface as well, and which device is at most overall about 1 foot in length along a central axis parallel to the forwardly directable edges and at most about ½ foot in length along sidewardly directable edges of its hitting surface.

21. The device of claim 20, which has sighting tabs for aligning the face of a golf club.

* * * * *